United States Patent [19]

Chas

[11] Patent Number: 4,902,254

[45] Date of Patent: Feb. 20, 1990

[54] PROPULSION DEVICE WITH CONDITIONED INERTIA

[76] Inventor: Jean-Bernard Chas, Villa Des Haules B. P. 23, 76 790 Etretat, France

[21] Appl. No.: 248,741

[22] Filed: Sep. 26, 1988

Related U.S. Application Data

[63] Continuation-in-part of Ser. No. 57,057, May 4, 1987, abandoned.

[30] Foreign Application Priority Data

Sep. 2, 1986 [WO] PCT Int'l Appl. ..... PCT/FR86/00294

[51] Int. Cl.[4] ..... B63H 11/02

[52] U.S. Cl. ..... 440/38; 440/47; 60/231

[58] Field of Search ..... 440/38, 39, 40, 41, 440/42, 43, 44, 45, 46, 47; 60/221, 222, 231

[56] References Cited

U.S. PATENT DOCUMENTS

| | | | |
|---|---|---|---|
| 1,498,919 | 6/1924 | Jensen | 60/222 |
| 3,233,573 | 2/1966 | Hamilton | 440/39 |
| 3,405,526 | 10/1968 | Aschauer | 440/47 |
| 3,678,689 | 7/1972 | Ishiwata | 60/221 |
| 3,800,731 | 4/1974 | Slade | 440/40 |
| 3,906,886 | 9/1975 | Elger | 440/38 |
| 4,411,630 | 10/1983 | Krautkremer et al. | 440/47 |

FOREIGN PATENT DOCUMENTS

| | | |
|---|---|---|
| 1901374 | 10/1970 | Fed. Rep. of Germany . |
| 2625818 | 12/1977 | Fed. Rep. of Germany . |
| 1555257 | 1/1969 | France . |
| 1011203 | 11/1965 | United Kingdom . |

*Primary Examiner*—Sherman D. Basinger
*Assistant Examiner*—Stephen P. Avila
*Attorney, Agent, or Firm*—Griffin, Branigan & Butler

[57] ABSTRACT

A hydraulic jet propelling apparatus has an inlet opening at one end and an outlet opening at the opposite end for a fluid passing therethrough. Between the inlet and outlet openings, a centrifugal accelerator member defines a divergent annular passageway for the fluid, with a frusto-conical external sleeve and a frusto-conical central vaned rotor member keyed together on a driving shaft. A stationary cup shaped wall projects from an outlet of the accelerator member, an internal face of which, seen in axial section, having a curvature variable from the outlet of the accelerator member to define at an outer end thereof a straight direction substantially axial to said internal face. The internal face being provided with a plurality of vanes for guiding and progressively changing direction of the accelerated fluid from a diverging and rotative trajectory when leaving the accelerator member to a trajectory parallel to the straight direction when leaving the wall.

9 Claims, 1 Drawing Sheet

PROPULSION DEVICE WITH CONDITIONED INERTIA

This application is a continuation-in-part application of U.S. patent application Ser. No. 07/057,057, filed May 4, 1987, now abandoned.

BACKGROUND OF THE INVENTION

The present invention relates to a device for propelling a marine craft with hydrojet reactive forces.

An object of the invention is to provide a jet propulsion apparatus in which thrust is augmented by suitable shaping or a pump section in order to accelerate water with reduced turbulence and by suitably shaping a discharge section in order to straighten water flow without introducing penalizing perturbations in the flow.

In the prior art, as illustrated by U.S. Pat. No. 3,233,573, G.B. Patent No. 1,011,203 or French Patent No. 1,555,257, water is accelerated in a more or less complex pump section. At a discharge end of this pump section, the velocity of the water has three components which are respectively axially, tangentially and radially oriented. When leaving the pump section, the water flow enters a discharge chamber in which it is straightened by means of vanes. The flow is deflected and restricted in order that its velocity be augmented when it leaves a single discharge opening of the chamber.

These deflections and restrictions are disadvantageous to thrust efficiency because they cause frictional loss and turbulences, so that pressure consequently increases in the fluid. This increasing pressure involves further frictional losses upstream which penalize performance of the device.

SUMMARY

Generally, an apparatus according principles of this invention includes:

a pump section comprising a hollow housing with an inlet opening at one end and an outlet opening at the other end, the housing containing a vaned rotor member in which a peripheral annular passageway is defined, having either a cylindrical shape or having its diameter increase from the inlet opening to the outlet opening to have an increasing accelerating effect on the water flow, the rotor being keyed to a driving shaft; and, a discharge section comprising a stationary cup shaped wall projecting from the outlet opening of the pump section, the wall having a concave face turned opposite to the pump section with a variable curvature which is substantially tangent to water flow exhausted through the outlet opening of the pump section and substantially parallel to a straight direction defined by an axis of the apparatus at its free end, this concave face being provided with at least curved vanes, regularly disposed on this surface and having a smooth curvature providing arcuate surface portions whereby the flow exhausting from the pump section is divided into a plurality of adjacent water jets which are progressively and smoothly straightened from their diverging trajectory to a trajectory substantially parallel to the straight direction. These arcuate surfaces are regularly disposed around the cup shaped wall at the vicinity of the outlet opening of the pump and may either keep this regular distribution along the cup shaped wall or are progessively oriented such that they form, at the free outer end of the cup shaped wall, several series of close vanes circumferentially spaced each from the others.

The vanes may be hollow adjacent curved ducts on the concave surface of the cup shaped wall, each having an inlet opening adjacent to the exhaust of the pump section, a first curved section along the cup, and a final straight section parallel to the straight direction.

By use of such ducts, the jets, during their straightening, are preserved form turbulences caused by a depression, or a decrease in pressure, which is present in the area of the center of the cup shaped wall.

If such a decrease in pressure exists, this depression may be compensated by filling this area with a gas, like an exhaust gas of a driving engine or air sucked atmosphere. This can be accomplished either by means of a feeding duct passing through the cup shaped wall or by passing fluid through a space between water jets resulting from a non-regular distribution of vans at the exhaust end of the cup shaped wall, when the jets are propelled at least partially into the air.

Apparatus constituting embodiments of the invention will now be described in more detail by way of example with reference to accompanying drawings.

DESCRIPTION OF THE DRAWINGS

Figure 1:
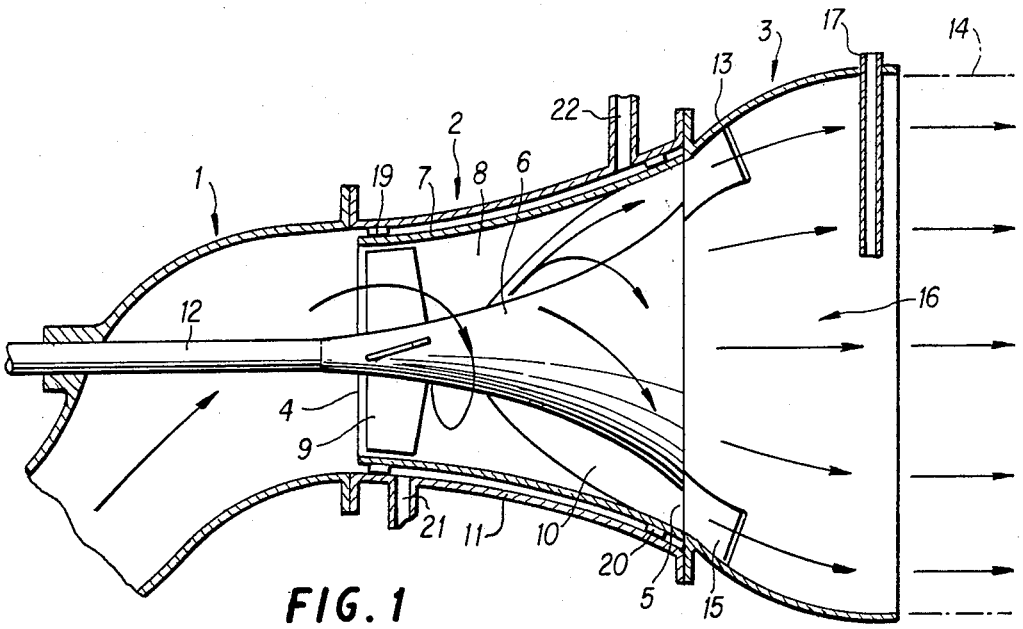
FIG. 1 is a schematic sectional view of a propulsion device according to the invention.

Referring to FIG. 1, an intake section 1, a pump section 2, and a discharge section 3 are depicted therein. The intake section 1 is, as usual, fitted to a hull of a craft (not shown). The pump section 2 has an inlet opening 4 communicating with the intake section 1, and an outlet opening 5, substantially annular in shape, which is defined by surfaces of a central truncated body 6 and a surrounding truncated sleeve 7 keyed with the body 6. Between the body 6 and the sleeve 7, an annular passageway 9 of increasing diameter extends between the inlet opening 4 and the outlet opening 5. Near the inlet opening 4, there is a variable pitch propeller 9 and vanes 10 integral with the body 6. In another embodiment, the annular passageway is cylindrical.

A rotor, including body 6, sleeve 7, propeller 9 and vanes 10, is rotated in a housing 11, fitted to the intake section 1, by means of a driving shaft 12. Thus, water entering the rotor is accelerated and centrifuged progressively and homogeneously to pass through the passageway 8. Energy thereby imparted to the water is transformed into kinetic energy without a significant increase of pressure.

A cup shaped wall 13 is fastened to the housing 11. This wall constitutes the discharge section 3 of the device.

Figure 2:
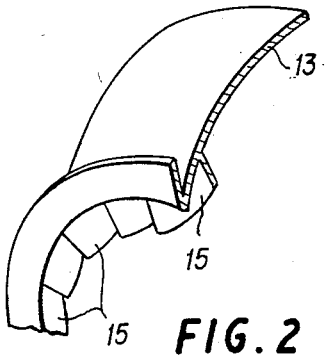
FIG. 2 is a schematic segmented view of a part of a cup shaped wall of the propulsional device taken on line 2—2 of FIG. 1.

This wall 13 is shaped so that water leaving the pump section 2 through the outlet opening 5 constitutes a cone which is tangent to the inner face of the wall 13 at its end adjacent to the housing 11. The curvature of the inner concave face of the wall 13 progressively varies to form a cylinder 14 at the end of wall 13 opposite to the end to which the housing 11 is fastened. Moreover, as shown in FIG. 2, the wall 13 is provided with stationary vanes 15, by which water trajectory is progressively straightened. It will be understood that any inner face of the wall partially transforms a centrifugal component of water inertia into an axial component. Energy dissipated by these transformations is reduced a maximum amount by employing properly calculated curvatures of wall 13 and vanes 15, and by employing an adapted design of their profiles and rugosity to be as small as possible.

These vanes are shown on the drawing as being regularly disposed around the inner surface of the cup shaped wall 13 and exhausting water passing therethrough is shaped substantially as a cylindrical curtain, an internal volume thereof being in a depression or having a reduced or negative pressure. It is also possible to provide the cup shaped wall 13 with vanes which are not regularly disposed thereon, at least at the exhaust end of the discharge section 3, to create several spaces between water jets exhausted. Through these spaces fluid (air or water can be fed to the central volume which tends to be depressed.

In the pump section 2, acceleration of the water is achieved with minimum turbulences and losses. Thanks to the invention, an accelerated flow of water when leaving the pump is disturbed to a minimal extent.

An internal volume of the wall 13 is subjected to a depression as mentioned above, resulting from ejection of the jet. This depression can disturb discharge flow. This volume or space can be fed with additional fluid (water or air) through a pipe 17, to conteract this depression or between spaced jets, when vanes are spaced apart. Other gases can be fed thereinto, such as exhaust gas of a driving engine.

Figure 3:
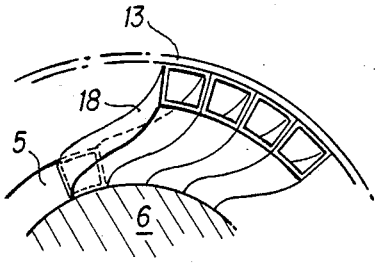
FIG. 3 is a segmented end view of another embodiment of the cup shaped wall viewed on its concave side; and, FIG. 4 is a segmented schematic top view of the embodiment of FIG. 3.
Figure 4:
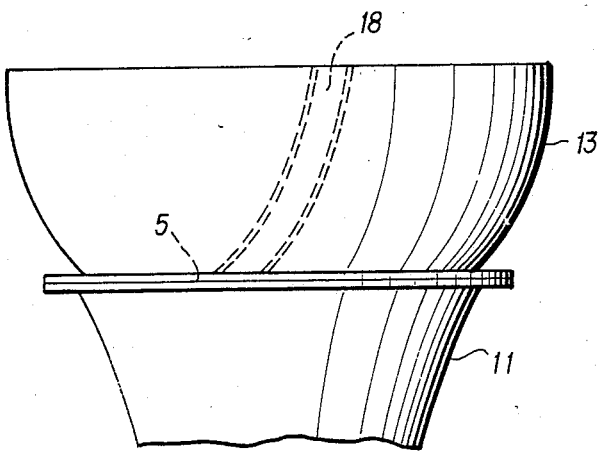

FIG. 3 shows schematically an alternate embodiment in which the cup shaped wall 13 is provided with adjacent tube sections, instead of vanes 15, in which the water can flow. Each individual stream in the tube section or duct 18 is completely preserved from effects of the depression inside the cup shaped wall 13. Obviously, the tubes 18, or tube sections, must be calculated precisely depending on nominal operation of the device. The tubes 18 open along a cylindrical path 14 (see FIG. 1). FIG. 4 shows, in a top view, a simple tube section 18 extending from the opening 5 to an outer end of the cup shaped wall 13.

When using this invention, it is advantageous to discharge water into the air. The cup shaped wall 13 can be shaped for helping to get this result. The rotor is not necessarily lined up with a thrust direction. This direction is the straight direction referred to hereabove about the cup shaped wall and can be modified with respect to a rotor axis. Ejection of the water can occur partially or totally above a water line into air.

The stern of a craft, which is located at the rear of the pump section, being partially under a water line, can rise out of the water when the craft is gaining speed.

Like other hydrojets of this kind, the device can be fitted with additional conventional devices for steering, thrust reversing, etc., for instance, moving curved or other kinds of flappers, water take up means, and the like. If the device is fitted inside a craft's hull, an aperture is made below the waterline, with a conveying pipe, a safety seacock, and a strainer mounted thereat. The rotor can also, by translation, be associated to one of two cup shaped walls of different design.

The size of the device has to be determined according to the amount of power supplied thereto, the speed expected on the water, and the craft's dimensional imperatives. The transmitting apparatus determines the rotational speed as well as the speed on the water.

In order to diminish frictional losses, it would be advantageous to dispose between the sleeve 7 and the housing 11, seals 19 and 20 and to connect, by means of pipes 21 and 22, a volume between these seals either to atmosphere, or to an area of the discharge section subjected to a depression.

I claim:

1. Hydrojet propelling device including:

a pump section comprising an elongated hollow housing with an inlet opening at one end and an outlet opening at the opposite end said housing containing at least a vaned rotor member in which a peripheral annular diverging passageway is defined between the inlet opening end and the outlet opening end through which water flow is associated, said rotor being keyed on a driving shaft; and, a discharge section comprising a stationary cup shaped wall projecting from the outlet opening of the pump section, said wall having a concave face curving oppositely to divergence of a surface forming the outer passageway of the pump section, this face having a variable curvature which is substantially tangent to the flow exhausted at the outlet opening of the pump section and substantially parallel to a straight direction along an axis of elongation at its free end, this concave face being provided with curved vanes having smooth curvatures in the axial direction providing arcuate surface portions whereby the flow exhausting from the pump section is divided in a plurality of water jets progressively and smoothly straightened from their diverging trajectory to a trajectory substantially parallel to said straight direction, said vanes being constituted by internal surfaces of tubes extending along said cup shaped wall.

2. Hydrojet propelling device as in claim 1, wherein a space between said housing and said rotor is sealed water tight from inside said hollow housing but is connected to outside atmosphere.

3. Hydrojet propelling device including:

a pump section comprising an elongated hollow housing with an inlet opening at one end and an outlet opening at the opposite end said housing containing at least a vaned rotor member in which a peripheral annular diverging passageway is defined between the inlet opening end and the outlet opening end through which water flow is accelerated, said rotor being keyed on a driving shaft, the water discharged from said peripheral annular diverging passageway being thereby shaped as a diverging hollow jet; and, a discharge section provided with means to preserve said hollow jet from being disturbed by a depression generated in an internal area of said hollow jet.

4. Hydrojet propelling device according to claim 3 wherein said means to perserve includes a feeding means for feeding said central area with a gas.

5. Hydrojet propelling device according to claim 4 wherein said feeding means include vanes to divide said hollow jet into separate spaced apart jets, said spaced apart jets defining between the passageways for atmospheric gas to enter the internal space.

6. Hydrojet propelling device according to claim 5 wherein said feeding means includes an exhaust pipe of the engine which rotates said pump section.

7. Hydrojet propelling device according to claim 3 wherein said discharge section comprises a stationary cup shaped wall projecting from the outlet opening of the pump section, said wall having a concave face curving oppositely to divergence of a surface forming the outer passageway of the pump section, this face having a variable curvature which is substantially tangent to the flow exhausted at the outlet opening of the pump section and substantially parallel to a straight direction along an axis of elongation at its free end, this concave face being provided with curved vanes having smooth curvatures in the axial direction providing arcuate surface portions whereby the flow exhausting from the pump section is divided in a plurality of water jets progressively and smoothly straightened from their diverging trajectory to a trajectory substantially parallel to said straight dirction.

8. Hydrojet propelling device according to claim 7 wherein said means for preserving said hollow jet from internal depression includes said vanes which are constituted by internal surfaces of tubes extending along said cup shaped wall.

9. Hydrojet propelling device according to claim 3 wherein said means to protect said hollow jet from the depression includes a means for equalizing said negative pressure.

* * * * *